United States Patent [19]

Asai et al.

[11] 4,105,004

[45] Aug. 8, 1978

[54] ULTRASONIC WAVE FUEL INJECTION AND SUPPLY DEVICE

[75] Inventors: Kiyokazu Asai; Akihiro Takeuchi, both of Nagoya, Japan

[73] Assignee: Kabushiki Kaisha Toyota Chuo Kenkyusho, Japan

[21] Appl. No.: 738,843

[22] Filed: Nov. 4, 1976

[30] Foreign Application Priority Data

Nov. 4, 1975 [JP] Japan ..... 50-132701

[51] Int. Cl.[2] ..... F02M 27/08

[52] U.S. Cl. ..... 123/141; 123/119 EE; 261/81; 261/DIG. 48

[58] Field of Search ..... 123/119 E, 119 EE, 141, 123/32 AB; 261/81, DIG. 48

[56] References Cited

U.S. PATENT DOCUMENTS

| | | | |
|---|---|---|---|
| 2,576,450 | 11/1951 | Marval | 123/119 E X |
| 2,791,994 | 5/1957 | Grieb | 123/119 EE |
| 2,907,648 | 10/1959 | Chapman | 261/DIG. 48 |
| 3,284,762 | 11/1966 | Kompanek | 261/DIG. 48 |
| 3,349,354 | 10/1967 | Miyata | 123/119 E |
| 3,804,329 | 4/1974 | Martner | 261/DIG. 48 |
| 3,805,492 | 4/1974 | King | 123/119 E X |
| 4,038,348 | 7/1977 | Kompanek | 261/DIG. 48 |

FOREIGN PATENT DOCUMENTS

| | | | |
|---|---|---|---|
| 2,318,779 | 1972 | Fed. Rep. of Germany | 261/DIG. 48 |

*Primary Examiner*—Charles J. Myhre
*Assistant Examiner*—Ira S. Lazarus
*Attorney, Agent, or Firm*—Oblon, Fisher, Spivak, McClelland & Maier

[57] ABSTRACT

An ultrasonic wave fuel injection and supply device includes an ultrasonic wave generating device and a fuel injection nozzle device. The ultrasonic wave generating device in turn includes an ultrasonic transformer, for transforming electrical oscillations into mechanical vibrations, connected to an ultrasonic oscillator, a mechanical vibration amplifier, for amplifying the amplitude of the mechanical vibrations, secured to the ultrasonic transformer, and a vibratory member, having a hollow cylindrically shaped body the peripheral wall of which is secured to the tip of the mechanical vibration amplifier with the axis of the vibratory member being disposed substantially perpendicular to the longitudinal axis of the mechanical vibration amplifier. The vibratory member has its opposite ends open and is disposed within an intake passage of an engine, the same therefore not hindering the flow of fluid through the intake passage. The fuel injection nozzle has its nozzle opening directed toward the peripheral wall of the vibratory member for injecting liquid fuel under pressure onto the peripheral wall. A fuel supply device introduces liquid fuel from a fuel reservoir to the injection nozzle, and a control device controls the amount of fuel being injected through the injection nozzle in response to the running conditions of the internal combustion engine. The ultrasonic wave fuel injection and supply device thus atomizes and scatters the liquid fuel injected onto the peripheral wall of the vibratory member as a result of the ultrasonic vibrations thereof, and the atomized and scattered liquid fuel is supplied to the combustion chamber of an engine, together with air from an air cleaner.

21 Claims, 5 Drawing Figures

ULTRASONIC WAVE FUEL INJECTION AND SUPPLY DEVICE

BACKGROUND OF THE INVENTION

1. Field of the Invention

The present invention relates to ultrasonic wave fuel injection and supply devices, and more particularly to such a device in which liquid fuel is supplied under pressure to an ultrasonic vibratory member, of a hollow, cylindricaly shaped body, positioned within an intake passage of an internal combustion engine, the fuel thus supplied being instantaneously atomized due to the ultrasonic vibration of the hollow cylindrically shaped body so as to be subsequently mixed with air and followed by the supply thereof, in a uniform air-fuel mixture, into the combustion chamber of the engine.

2. Description of the Prior Art

Prior art fuel injection devices for use in internal combustion engines provide many advantages in engine performance and purification of the exhaust gases, since the aforenoted devices provide uniform distribution of the air-fuel mixture to the respective cylinders in a multiple cylinder type engine, as well ss the precise control of the air-fuel ratio of the charge mixture to be supplied to the engine in accordance with the running conditions of the engine.

Such prior art fuel injection devices, however, intend to atomize the fuel by injecting the same under pressure through a nozzle having a minute exit for atomizing the fuel due to shear forces impressed upon the fuel, caused by frictional resistance between the injected fuel and the surrounding air. The prior art fuel injection devices thus fail to meet success in injecting fuel under such desired high pressures, that is, the injection speed of the fuel through the nozzle is low, resulting in a failure to provide the fine particles of fuel having a minute size. In addition, the prior art fuel injection devices pose another shortcoming in that because of the failure to achieve the uniform shear forces of the fuel caused by the frictional resistance between the injected fuel and air, there results a lack of uniformity in size of the fuel particles atomized. It follows from this that the prior art fuel injection devices impair the desired running performance of the engine using a charge mixture having a high air-fuel ratio, because of the insufficient production of a uniform lean charge mixture.

An attempt to further reduce the size of the fuel particles atomized necessarily leads to an increase in the injection pressure of the fuel, and this dictates the provision of a high pressure pump. As a result, the size of the pump must be increased, and hence, a high manufacturing cost results, with an accompanying increase in load imposed upon the internal combustion engine. Still further, the prior art fuel injection devices fail to reduce the amount of harmful gases to the desired extent, because of the large average size of the particles of atomized fuel generated and the distribution of the size of such fuel particles over a wide range.

SUMMARY OF THE INVENTION

Accordingly, it is an object of the present invention to provide an ultrasonic wave fuel injection and supply device which avoids the aforenoted shortcomings encountered with prior art devices of the type described.

Another object of the present invention is to provide an ultrasonic wave fuel injection and supply device wherein the amount of fuel being supplied is controlled commensurate with the running conditions of the internal combustion engine.

Still another object of the present invention is to provide an ultrasonic wave fuel injection and supply device wherein the fuel to be injected through an exit or exits of an injection nozzle means is directed toward the peripheral wall of an ultrasonic vibratory member of a hollow, cylindrically shaped body having a large surface area, which member is positioned within the intake passage of the fuel injection means of the engine.

Yet another object of the present invention is to provide an ultrasonic wave fuel injection and supply device wherein the fuel thus injected is instantaneously and completely atomized due to the ultrasonic vibrations caused by the vibratory member of the hollow, cylindrically shaped body, whereupon the fuel thus atomized is thoroughly mixed with air due to the vibration of the air caused by the ultrasonic waves within the space surrounding the aforenoted cylindrically shaped body.

A further object of the present invention is to provide an ultrasonic wave fuel injection and supply device wherein a uniform charge mixture is supplied to the combustion chamber of the engine.

According to the present invention, there is provided an ultrasonic wave fuel injection supply device which includes an intake passage one end of which is communicated with an air cleaner and the other end of which is communicated with a combustion chamber of the internal combustion engine. The intake passage supplies an air-fuel mixture therethrough and has a fuel injection means therein consisting of an ultrasonic wave generating means and a fuel injection nozzle means, the ultrasonic wave generating means consisting of (i) an ultrasonic transforming portion, connected to an ultrasonic oscillator, for transforming electric oscillations into mechanical vibrations, (ii) a mechanical vibration amplifying portion secured to the ultrasonic transforming portion for amplifying the amplitude of the mechanical vibrations, and (iii) a vibratory member, of a hollow cylindrically shaped body, having a peripheral wall, secured to the tip of the mechanical vibration amplifying portion, the axis of the vibratory member being positioned substantially perpendicular to the longitudinal axis of the mechanical vibration amplifying portion. The vibratory member has opposite ends which are open and the same is positioned in the intake passage, whereby the structure thereof does not hinder the flow of a fluid through the intake passage. The fuel injection nozzle means has a nozzle exit or exits directed toward the peripheral wall of the vibratory member for injecting liquid fuel onto the peripheral wall under pressure, fuel supply means being provided for introducing liquid fuel from a fuel reservoir to the injection nozzle means. Control means, for controlling the amount of fuel being injected through the injection nozzle means in accordance with the running conditions of the internal combustion engine is also provided, whereby liquid fuel injected onto the peripheral wall of the vibratory member undergoes ultrasonic vibration and may be atomized and scattered due to the ultrasonic vibrations thereof, and subsequently, the liquid fuel thus atomized and scattered may be supplied to the combustion chamber of the engine, together with air from the air cleaner.

According to the present invention, the amount of liquid fuel being supplied to the combustion chamber of the engine is controlled by the control means, and the fuel thus controlled is injected through an exit or exits of the injection nozzle means towards the peripheral wall of the ultrasonic vibratory member, having a hollow cylindrically shaped body, so that the fuel supplied to the cylindrical peripheral walls of the vibratory member, that is, to vibratory surfaces of a large area, is spread over the vibratory surfaces of the vibratory member due to the high frequency ultrasonic vibrations so as to thereby produce a liquid film thereover, the liquid film thus produced then being atomized into minute particles due to the surface waves having a given wave length, which have been caused by the ultrasonic waves, followed by injection of the fuel.

As a result, there may be obtained atomized fuel having more minute and uniformly-sized particles, as compared with those obtained from prior art devices, and the liquid fuel thus atomized into such minute particles flows around the aforenoted vibratory member so as to be thoroughly mixed with air within the engine intake passage, which air is also subjected to such ultrasonic vibrations of the vibratory member, thereby producing a uniform air-fuel mixture to be supplied into the combustion chambers of the internal combustion engine. Accordingly, there may be achieved the supply of a uniform lean charge mixture to the engine, with the accompanying consistent and stable combustion of a lean charge mixture, such insuring the desired running condition of the engine and a reduction in the amount of harmful exhaust gases.

Furthermore, according to the present invention, fuel is supplied to the peripheral wall, of a large surface area, of an ultrasonic vibratory member of a hollow, cylindrically shaped body, and then the fuel thus supplied may be atomized due to the uniform ultrasonic vibrations over the entire surface of the vibratory member of the hollow cylindrically shaped body, so that there may be achieved a uniform sizing of particles of atomized fuel as compared with that of the particles of fuel atomized according to the prior art fuel injection devices. In addition, the size of the particles of atomized fuel may be predetermined by selecting the amplitude and frequency of the ultrasonic waves, so that extremely fine particles of atomized fuel may be supplied and a charge mixture containing atomized fuel of a desired particle size, effective for reducing the harmful constituents of the exhaust gases, may be supplied to the combustion chamber of an engine, thereby effectively purifying the exhaust gases further.

Still further, according to the present invention, there is no need to inject the fuel through a nozzle in a fuel injection device at a high pressure as in the prior devices for directly atomizing the fuel due to the injection therethrough. Namely, according to the present invention, fuel is only injected through the nozzle onto the vibratory member undergoing ultrasonic vibration for contacting the injected fuel with the vibratory member and instantaneously spreading the same over the entire vibratory surface thereof, and therefore the injection of fuel through the nozzle may be effected under a low pressure, thus dispensing with the use of high pressure injection as in the prior art fuel injection devices. As a result, in the device according to the present invention, the injection nozzle means is simple in construction, and the compressor is small in size as compared with those in the prior art fuel injection devices, and hence, the device is less costly and more readily maintained.

The present invention may thus be practiced in accordance with two aspects of the invention. The feature of the first aspect of the invention lies in the fact that a plurality of injection nozzle means in the fuel injection device are each provided for respective cylinders of the engine and disposed in the vicinity of the intake ports of the combustion chambers of the engine, respectively, whereby fuel supplied to the peripheral wall of the ultrasonic vibratory member, through an exit of the injection nozzle means, is instantaneously atomized due to the ultrasonic vibration of the vibratory member, whereupon the fuel thus atomized may be promptly supplied to each combustion chamber of the engine.

The feature of the second aspect of the invention lies in the fact that a single fuel injection means is positioned in the upstream portion of a branching port of the intake exhaust manifold, so that, as in the first aspect of the invention, fuel atomized due to the ultrasonic vibrations may be distributed through the manifold and into the respective combustion chambers of the engine.

Thus, the ultrasonic fuel injection and supply device according to the present invention consists of a hollow, cylindrically shaped body having a large surface area, and liquid fuel of a great amount may be atomized due to ultrasonic vibration thereof for a given period of time, while the fuel thus atomized provides extremely fine particles dispersed in a charge mixture so that a uniform mixture may be supplied to respective combustion chambers of a multicylinder engine, with advantages as mentioned above, and additional advantages, such as a reduction in cost and maintenance.

BRIEF DESCRIPTION OF THE DRAWINGS

Various other objects, features and attendant advantages of the present invention will be more fully appreciated as the same becomes better understood from the following detailed description of the present invention when considered in connection with the accompanying drawings, in which.

DETAILED DESCRIPTION OF THE ILLUSTRATED EMBODIMENTS

Figure 1:
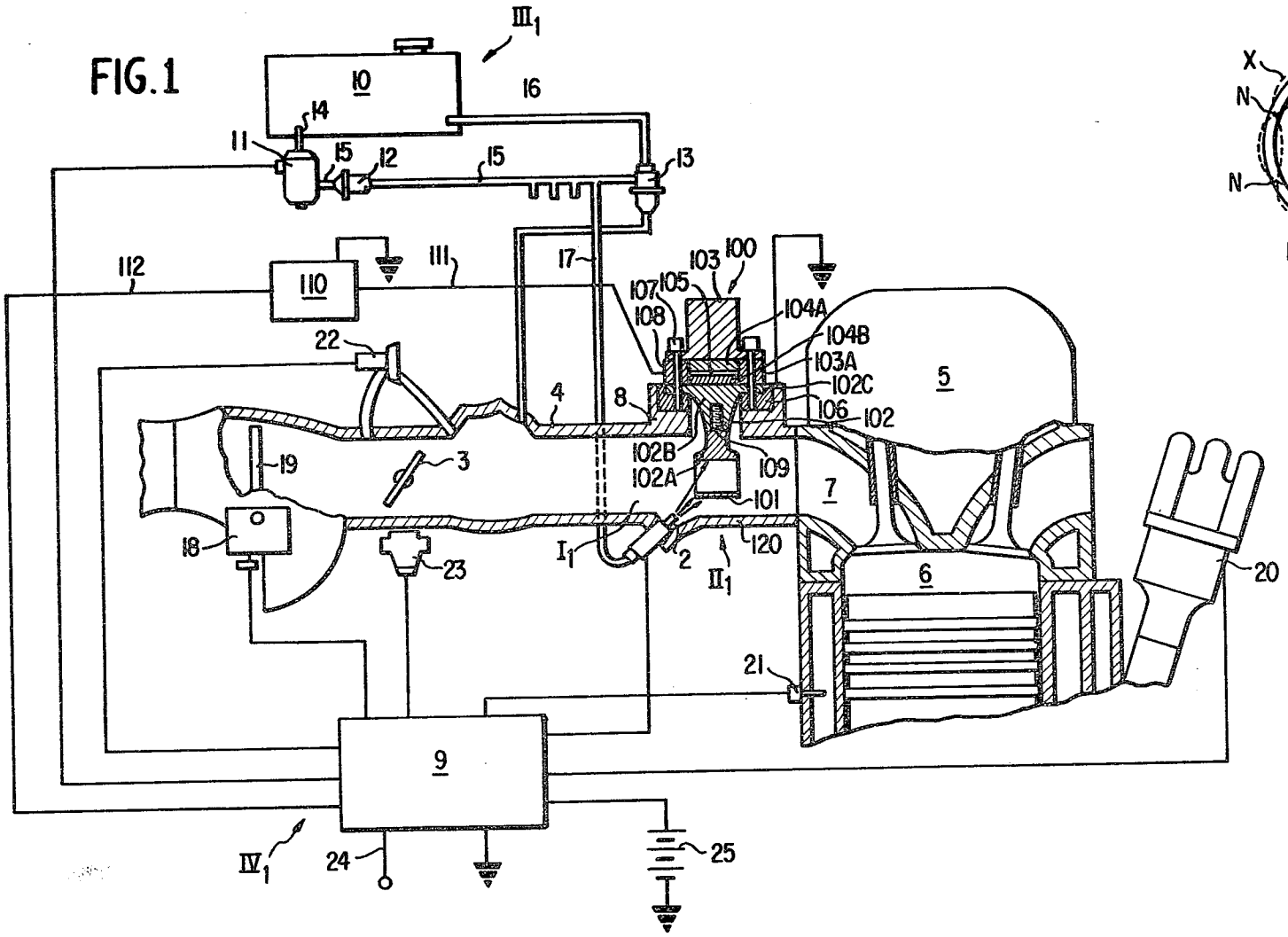
FIG. 1 is a schematic view, partly in cross section, of a first embodiment of an ultrasonic wave fuel injection and supply device constructed according to the present invention.

Referring now to the drawings, and more particularly to FIG. 1 thereof, an ultrasonic wave fuel injection and supply device comprising the first embodiment of the present invention is seen to include an ultrasonic vibratory member 101 having a hollow cylindrical body which is positioned within an intake passage $I_1$ in a substantially coaxial relation thereto with one opening of the cylinder directed towards the upstream end of the intake passage $I_1$ and the other opening directed towards the downstream end thereof, the aforenoted intake passage $I_1$ being adapted to admit fresh air thereinto and supply an air-fuel mixture therethrough, the same being included in a fuel injection device $II_1$.

In this embodiment and the embodiments to be described below, the cylinder is hollow and has a circular configuration in radial cross-section, and is of a predetermined length between the opposite ends thereof. The cylinder also has a thin wall of constant thickness in the axial and radial directions thereof, that is, the inner and outer peripheral wall surfaces of the cylinder are in coaxial relation with respect to each other.

In addition, a fuel injection nozzle, of the type such as that used in prior art fuel injection devices is positioned in the upstream end of the intake passage in such a manner that a circular opening or exit of the injection nozzle is directed in an inclined manner in the downstream direction towards the member 101 and more particularly towards the axis of the vibratory member 101. According to this injection device, a diverging spray of fuel from the nozzle is generated so as to cover the inner and outer peripheral surfaces of the hollow cylinder which undergoes ultrasonic vibration, with the result that the fuel supplied to the inner and outer peripheral surfaces of the hollow cylinder is atomized thereon.

An upstream end of the intake passage $I_1$, defined by means of a short pipe 120, is connected to the downstream end of an intake pipe 4 within which there is provided a throttle valve 3 which is adapted to control the amount of intake air, while the downstream end of the intake passage $I_1$ is connected to an intake port 7 leading to a combustion chamber 6 of an engine 5.

The fuel injection device $II_1$ consists of an ultrasonic wave generating body 100 having the ultrasonic vibratory member 101 of the hollow cylindrical configuration, and the fuel injection nozzle 2 which maintains a given positional relationship with respect to the vibratory member 101, as will be described hereinafter.

The ultrasonic wave generating body 100 is rigidly secured upon a seat 8 formed on the wall of the intake passage $I_1$ in the fuel injection device $II_1$, while the ultrasonic vibratory member 101 protrudes into the central portion of the intake passage $I_1$ in a substantially coaxial manner. Secured to the wall of the intake passage in a position diametrically opposed to the seat 8, yet upstream of the ultrasonic vibratory member and inclined in the downstream direction, is the fuel injection nozzle 2, the inclination of which is approximately 45° with respect to the axis of the intake passage $I_1$ and the exit of which is directed towards the center of the vibratory member 101. Thus, fuel injected through the nozzle 2 may impinge upon the inner and outer peripheral surfaces of the hollow cylindrical body of member 101. A prior art fuel injection device, as used in a prior art internal combustion engine, may be used intact as the fuel injection nozzle according to the present invention.

Figure 2:
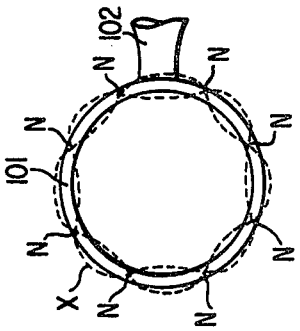
FIG. 2 is a schematic view of the vibratory member of the apparatus of FIG. 1, showing the vibrating state thereof.

The ultrasonic wave generating body 100 consists of the ultrasonic vibratory member of a large surface area as has been described hereinabove, thereby producing powerful ultrasonic waves therefrom. In addition, the body 100 is extremely small in size, and hence, may be built into the intake passage for the engine combustion chamber. Piezo-electric elements 104A and 104B are sandwiched between a backing block 103, and an ultrasonic vibration amplifying block 102, provided in the form of an exponential type horn, serving as a mechanical vibration amplifying portion, and are secured in position by means of suitable fastening means. The vibratory member 101 is integrally formed on the tip portion of the ultrasonic vibration amplifying block 102, with the axis of the vibratory member 101 being disposed perpendicular to the axis of the ultrasonic vibration amplifying block 102. The ultrasonic vibration amplifying block 102 serves as an ultrasonic transforming portion with the aid of the piezo-electric elements and backing block, and also serves as a horn which is adapted to amplify the mechanical vibrations produced within the ultrasonic wave transforming portion. The vibratory member 101 vibrates, or as shown in FIG. 2, causes flexural vibration, at the same frequency as that of the ultrasonic vibrations which have been transformed by the aforenoted piezo-electric elements and then amplified in its amplitude.

The ultrasonic vibration amplifying block 102 consists of two components 102A and 102B, the component 102A, that is, the tip portion thereof being integrally fastened to the rear portion 102B of the block 102 by means of a bolt 109. A root portion of the block 102 is formed with a flange 102C, within which there are provided a plurality of bolt holes, and an annular supporting plate 106 is fitted on the flange 102C so as to reinforce the same in its bending rigidity. The supporting plate is provded with a plurality of female, threaded holes, into which a plurality of bolts 107 are threaded. Thus, by means of these bolts 107, the flange 102C is integrally secured to the flange 103A of the symmetrically opposed backing block 103, with piezo-electric elements 104A and 104B, electrode plate 105, and spacer plate 108 sandwiched therebetween. Connected to the electrode plate 105 is a lead wire 111 which is connected to the output side of an ultrasonic oscillator 110, while an input-side lead wire 112 of the oscillator 110 is connected to a control unit 9.

A fuel supply portion $III_1$ comprises a fuel reservoir 10, a fuel pump 11 connected by means of a tube 14 to the reservior 10, a pressure regulator 13 connected by means of a fuel filter 12 and a fuel transporting tube 15 to pump 11, with an excessive-fuel-discharge tube 16 also being connected from the pressure regulator 13 to the fuel reservoir 10, and an injection fuel supply tube 17, one end of which is communicated with the fuel transporting tube 15 while the other end thereof is communicated with the fuel injection nozzle 2. Thus, fuel is delivered from the fuel pump 11, by mans of the pressure regulator 13 which regulates the pressure level, to the fuel injection nozzle 2. As has been described earlier, the fuel injection nozzle 2 is designed in the same manner as that of a prior art fuel injection device, and the nozzle 2 is of a type in which the fuel injection exit may be opened or closed according to the operation of an electromagnet, that is, the same embodies a needle valve structure.

As has also been described earlier, according to the fuel injection device of the present invention, there is no need to inject fuel through the exit of the nozzle at a high pressure for atomizing the same due to shear forces, the fuel only being injected through the nozzle to the peripheral wall of the ultrasonic vibratory member 101 for atomization. Consequently, the fuel which has been fed from the fuel pump 11, and whose pressure is maintained at a given pressure level by the prssure regulator 13, may simply be injected towards the ultrasonic vibratory member 101 when the exit of the nozzle is opened by means of the electromagnet of the needle valve structure, even if the pressure of the fuel is extremely low. In addition, even in case the pressure level of the fuel is regulated to a high level by means of the pressure regulator 13, and part of the fuel is atomized as the same passes through the nozzle, only if a majority of the fuel from the nozzle impinges on the peripheral wall of the ultrasonic vibratory member 101 will the fuel be atomized into extremely fine particles, thereby attaining the objects of the present invention.

The fuel flow control portion $IV_1$ is of the electronic control type for detecting the air flow rate. More particularly, there is provided an air flow meter 18, in the upstream portion of the intake passage $I_1$ housing therein the throttle valve 3 which is adapted to control the amount of intake air, and the flow rate of air flowing through the intake passage $I_1$ is detected as a rotational displacement of a gauge plate 19 of air flow meter 18, which value is transformed into an electrical signal by means of a potentiometer, which signal is, in turn, fed to the control unit 9 adapted to control the flow rate of fuel. In addition, an ignition signal from a distributor 20 is also fed to the control unit 9, which in turn determines the amount of fuel to be injected, in accordance with the running condition of the engine, and the control signal produced thereby is fed to the electromagnetic needle valve of the aforenoted fuel injection nozzle 2.

A temperature sensor 21 is adapted to detect the temperature of the cooling water in the engine, and a signal produced therefrom is also fed to the aforenoted control unit 9. An auxiliary air valve 22 is provided within an air bypass, not numbered, whose ends open into the aforenoted intake passage $I_1$ on the upstream and downstream sides of the throttle valve 3, respectively. Accordingly, an idle air flow rate may be determined and varied in association with the cooling water temperature for maintaining an optimum idle R.P.M. rate during the time from the starting of the engine to an optimum warming-up temperature, while the air-fuel ratio of the charge mixture during warming-up may be adjusted by the control unit 9. A throttle switch 23 is operable in association with the throttle valve 3, and the deceleration timing of the engine may be detected, based upon a signal from the throttle switch 23 and upon the engine R.P.M. as detected by the ignition signal from the distributor 20, and consequently, the supply of fuel is able to be interrupted by means of the control unit 9 as required. Connected to the control unit 9, there is of course provided a starting switch 24 and a power source 25, such as a generator or battery.

A description will now be given of the operation of the first embodiment of the present invention having the aforenoted arrangement. When the starting switch 24 is closed upon the starting of the internal combustion engine, and the control unit 9 and ultrasonic oscillator 110 are put into operation, electrical oscillations, having the same frequency as a resonance frequency of the ultrasonic wave generating body 100, are produced within the ultrasonic oscillator and are fed to the piezoelectric elements 104A and 104B so that the ultrasonic wave generating body 100 produces longitudinal vibrations with the lower surface of the flange 102C, that is the surface nearer the vibratory member 101, serving as a node of vibration. The amplitude of the aforenoted longitudinal vibration is amplified by means of the ultrasonic vibration amplifying block 102, and then, the aforenoted longitudinal vibration is transmitted to the ultrasonic vibratory member 101 within the fuel injection device $II_1$. Accordingly, the vibratory member causes vibrations or flexural vibrations of a large amplitude.

FIG. 2 illustrates the case wherein the aforenoted vibratory member caues a fourth order flexural vibration. The entire peripheral surface of the vibratory member 101 causes a first set of elastic deformations, shown by X, at half cycles of vibration, and then causes another set of elastic deformations, having a phase inverse to that of the former and shown by Y, at another half cycle, with the result that powerful ultrasonic vibrations may be produced upon the inner and outer vibratory peripheral surfaces of the hollow cylindrical body. In this case, the amplitude of vibration may be varied by varying the amount of electrical energy charged, so that the amount of fuel to be atomized, the size of the fuel particles, and the like, may also be controlled.

Referring to the fuel supply portion $III_1$, a fuel pump 11 is operated so that fuel within the fuel reservoir 10 may be pumped out therefrom, after which the fuel is maintained at a given pressure level by means of the pressure regulator 13 and then supplied by means of fuel supply tube 17 to the fuel injection nozzle 2. At the same time, the control unit 9 within the aforenoted control device $IV_1$ governs the amount of fuel to be supplied, in accordance with the running conditions of the engine. In response to the introduction of air into the respective cylinders of the engine, a signal is fed from the control unit 9 to the electro-magnetic needle valve provided in conjunction with the fuel injection nozzle 2 for opening the aforenoted valve so that fuel of a given amount may be supplied through the exit of the fuel injection nozzle 2 and onto the inner and outer peripheral surfaces of the vibratory member 101. Fuel supplied to the vibratory member 101 may then of course be instantaneously atomized into extremely fine particles due to the ultrasonic vibrations thereof, and fed into the intake passage $I_1$ whereupon the fuel thus atomized may be thoroughly mixed with air surrounding the vibratory member due to the ultrasonic waves produced within the aforenoted air, after which the mixture thus produced is fed through intake port 7 and into the combustion chamber 6 of engine 5.

With the ultrasonic fuel injection and supply device constructed according to this embodiment, fuel injected through the injection nozzle may be atomized due to the ultrasonic vibrations thereof upon the inner and outer peripheral surfaces of the cylindrical wall of the vibratory member so that atomized fuel particles, of a size much smaller than that of fuel particles obtained from prior art fuel injection devices, may be obtained. In addition, due to the uniform distribution of the ultrasonic vibrations over the entire peripheral surfaces of the vibratory member, a charge mixture, including the atomized fuel particles of a uniform size, may be supplied to the combustion chamber of the engine thereby enabling satisfactory combustion of a lean charge mixture with resulting improvements in the running performance of the engine when using such a lean charge mixture. In addition, the generation of harmful gases is prevented so as to obtain purification of the exhaust gases, and still further, improvements in fuel consumption, and the like, are also obtained.

Still yet further, with the ultrasonic wave fuel injection and supply device constructed according to this embodiment, the inner and outer peripheral srufaces of the vibratory member 101, having a large surface area, may be effectively utilized as the fuel atomizing surfaces, so that a great amount of fuel may be atomized, thus fulfilling the fuel requirements arising from the engine over a wide range of operation of the engine.

Figure 3:
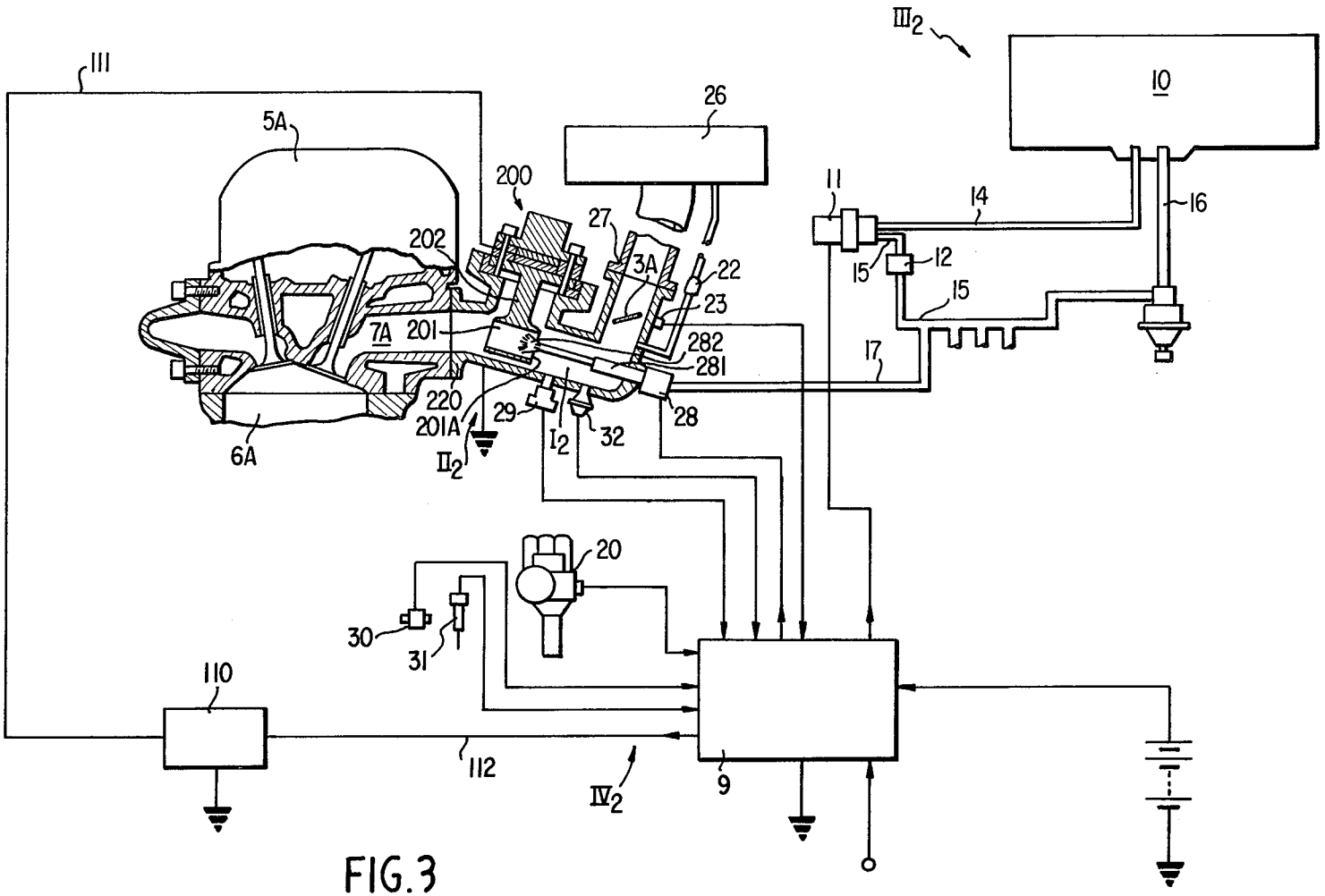
FIG. 3 is a schematic view, partly in cross section, of a second embodiment of the invention.

The description will now be turned to an essential part of the second embodiment constructed according to the first aspect of the present invention as seen in connection with FIG. 3. The same parts as in the first embodiment are designated by the same reference numerals, and consequently, an explanation thereof is omitted herefrom.

The primary feature of the ultrasonic fuel injection supply device in this embodiment lies in the fact that, as shown in FIG. 3, fuel is injected following a divergent pattern, that is, in a conical form through a fuel injection nozzle in the fuel injection portion $II_2$, and the fuel thus injected impinges upon the inner peripheral wall surface of an ultrasonic vibratory member 201 of a hollow, cylindrical body for atomization of the fuel.

An intake passage $I_2$ is defined by means of a short pipe 220 connected at its upstream end to an intake tube 27 leading to an air cleaner 26, while the downstream end of the intake passage $I_2$ is connected to an intake port 7A leading to a combustion chamber 6A of an engine 5A. The intake passage $I_2$ includes a portion bent at an angle of 90° at a position midway thereof, and a throttle valve 3A is positioned in the upstream portion of the bent portion for controlling the amount of intake air.

An ultrasonic wave generating body 200, disposed in the fuel injecting portion $II_2$, is secured to the wall of the intake passage $I_2$ at a position downstream of the aforenoted bent portion, in the same manner as in the preceding embodiment. An ultrasonic vibratory member 201 protrudes into the intake passage $I_2$, with the axis of the vibratory member in alignment with the axis of the intake passage $I_2$. In addition, an injection nozzle 28 extends through a wall of the bent portion of the intake passage and is fixed thereto from the outside thereof with a tip portion 281 of the injection nozzle 28 protruding into the intake passage $I_2$. The fuel injection nozzle 28 is of the type, in which, as in the first embodiment, the exit of the nozzle may be opened or closed according to the operation of an electromagnetic needle valve as in a prior art fuel injection device. As in such a prior art nozzle, the nozzle 28 used in this embodiment injects fuel following a divergent pattern, that is, in a conical form, when the electromagnetic needle valve opens the exit of the injection nozzle. In this respect, the center of the annular opening or exit 282 of the nozzle 28 is in alignment with the axis of the aforenoted vibratory member 201 and extends into an opening 201A of the vibratory member 201, which opening is positioned on the upstream side thereof. Still further, the fuel injection nozzle 28 permits the divergent spreading of the fuel which has been discharged through the exit 282 of the nozzle 28 in a conical form, as well as the supply of fuel to the entire inner peripheral wall surface of the vibratory member 201.

The ultrasonic wave generating body 200 includes an ultrasonic vibration amplifying block 202, of a step type horn, serving as a mechanical vibration amplifying portion, while the vibratory membelr 201 is integrally formed on the tip portion of the ultrasonic vibration amplifying block 202, as in the first embodiment. The remaining structure of the ultrasonic wave generating body 200 and that of the fuel supply portion $III_2$ is not different from that of the first embodiment, and hence, a description thereof is omitted herefrom.

A fuel-supply-amount control device $IV_2$ in this embodiment is of the electronic control type which detects the pressure within the intake pipe. A sensor 29 is secured to the wall of the intake passage $I_2$ at a position downstream of the aforenoted bent portion of the intake passage $I_2$ so as to sense the pressure within the intake pipe. In other words, the sensor 29 senses or detects the pressure of the mixture to be introduced into the combustion chamber 6A of engine 5A, thereby feeding an electrical signal to a control unit 9 serving to control the fuel supply amount. In addition, an ignition signal from a distributor 20, and electrical signals representing temperatures of the cylinder head and crank case of the engine, which have been detected by temperature sensors 30 and 31, are also fed to the control unit 9. The control unit 9 determines the amount of fuel to be supplied within each cycle, commensurate with the running conditions of the engine, while a control signal therefrom may be fed to an electromagnetic needle valve for the aforenoted fuel injection nozzle 28. An intake-pipe internal-pressure switch 32 is actuated when the engine output is to be increased under a running condition approximating a fully opened position of the throttle valve 3A, and the air-fuel ratio at this time is adjusted by means of the control unit 9. The remaining structure of this embodiment is the same as that of the preceding first embodiment.

A description will now be given of the operation of the second embodiment. As in the first embodiment, the fuel supply control device $IV_2$ determines the optimum amount of fuel, in accordance with the running condition of the engine, and then , a given amount of fuel is supplied or injected through the fuel injection nozzle 28 onto the inner peripheral surface of the ultrasonic vibratory member 201 in the fuel injection portion $II_2$. Accordingly, fuel supplied to the inner peripheral surface of the vibratory member 201 may be instantaneously atomized due to the ultrasonic vibrations thereof, such thereby giving extremely fine fuel particles, such atomized fuel then being thoroughly mixed with air due to the vibration of the air which is also caused by the ultrasonic vibrations of the vibratory member 201 within the intake passage. The mixture is then fed by means of the intake port 7A, provided for the engine 5A, into combustion chamber 6A. The ultrasonic wave fuel atomizing device in this embodiment may thus supply a charge mixture for the engine in a satisfactory manner, thereby improving the running performance of the engine and purification of the exhaust gases.

In addition, according to this embodiment, since the fuel is injected through an annular exit of the nozzle onto the inner peripheral surface of the vibratory member having a hollow, cylindrically shaped body, almost the entire amount of fuel injected may be caught by the vibratory member, thereby further enabling the complete atomization of the fuel due to the ultrasonic waves.

Figure 4:
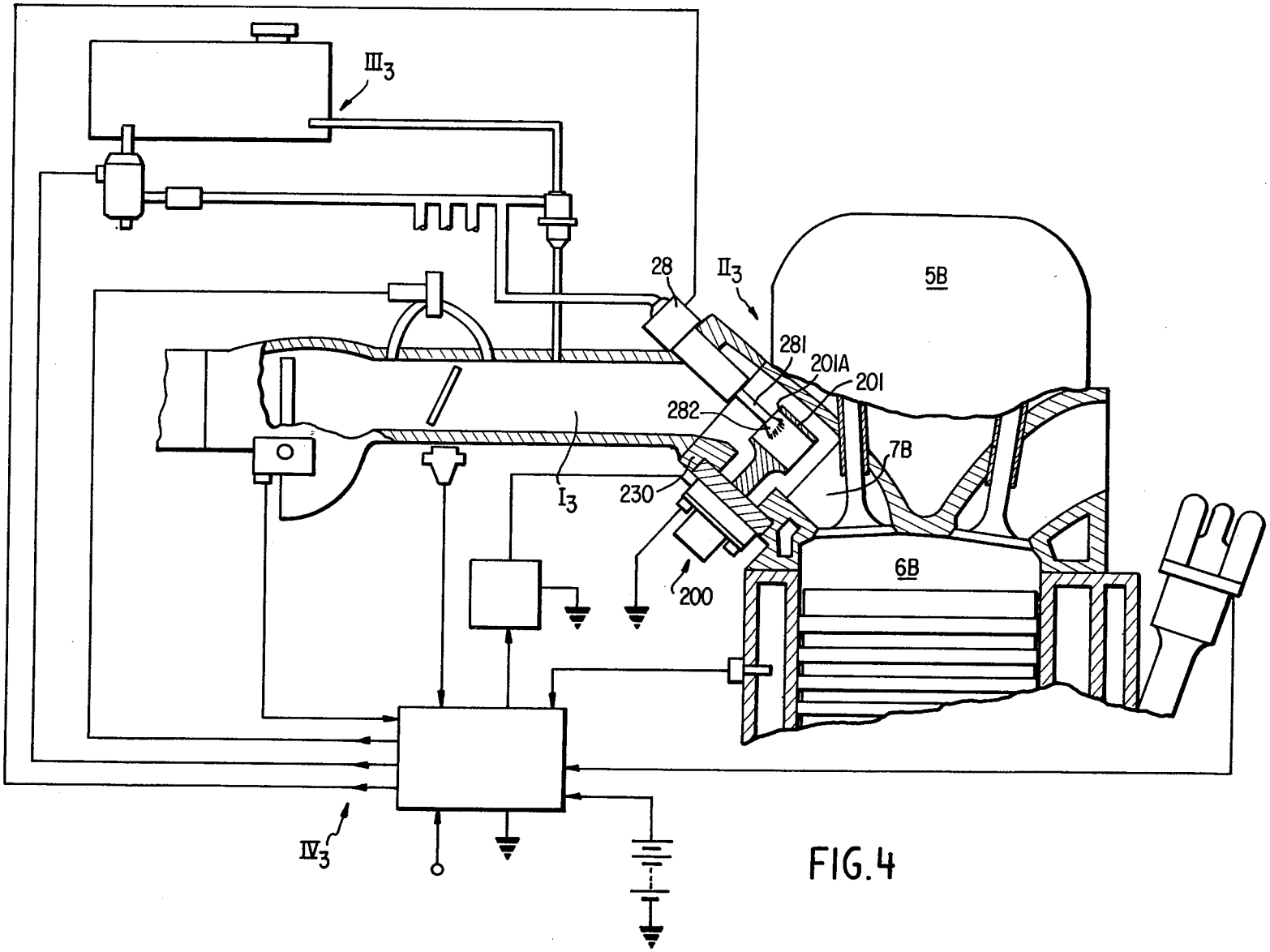
FIG. 4 is a schematic view, partly in cross section, of a third embodiment of the invention.

Still further, the first aspect of the invention may be modified as shown in FIG. 4, wherein the description will not be turned to an essential part of the third embodiment thereof in conjunction with FIG. 4. According to the ultrasonic wave fuel injection and supply device of this embodiment, an ultrasonic vibratory member 201, having a hollow cylindrical body, is part of a fuel injection device $II_3$ and is positioned within an intake part 7B which is a downstream portion of an intake pasage $I_3$ of an engine 5B, fuel injection device $II_3$ being adapted to atomize the fuel due to the ultrasonic vibrations thereof and the same is positioned in the vicinity of a combustion chamber 6B of the engine 5B.

Secured through the lower wall surface of the intake port 7B leading to combustion chamber 6B and fixed thereto from the outside thereof is an ultrasonic wave generating body 200, the ultrasonic vibratory member 201 thereof being positioned within the intake opening 7B in an inwardly protruding relation with respect thereto. An injection nozzle 28 is inserted, from the outside of passage $I_3$, into a short pipe 230 which defines an intake passage upstream of port 7B, with a nozzle tip 281 of the injection nozzle 28 protruding into the intake port 7B. In this respect, an annular exit 282 of the nozzle 28 is positioned on the axis of the vibratory member 201 and extends into an opening 201A of the vibratory member 201 on its upstream side. As in the second embodiment, the injection nozzle 28 enables the injection of fuel following a divergent pattern, that is, in a conical form through the exit 282 thereof, and the fuel injected may be supplied in its entirety onto the inner peripheral surface of the vibratory member 201.

The other structure of the third embodiment is the same as that of the first and second embodiments, and it is seen that in this embodiment, as well, the control device $IV_3$ determines the optimum amount of fuel to be injected, commensurate with the running condition of the engine, and the fuel thus injected through the injection nozzle 28 is supplied to the inner peripheral surface of the ultrasonic vibratory member 201 in the fuel injection device $II_3$ for atomization due to the ultrasonic vibrations thereof.

Accordingly, the ultrasonic wave fuel injection device in this embodiment may supply fuel in the form of extremely fine particles of a uniform size to the engine, thereby improving the running performance of the engine and purification of the exhaust gases. In this embodiment, atomization of the fuel due to the ultrasonic waves may take place at a position closer to the combustion chamber of the engine than in the preceding embodiments so that the length of the passage for feeding the fuel to the combustion chamber may be shortened, thereby reducing the amount of fuel tending to cling to the inner wall surface of the intake passage $I_3$, so that substantially the entire amount of fuel supplied may be fed to the combustion chamber of the engine, whereby cold starting, for example, of the engine is facilitated.

Figure 5:
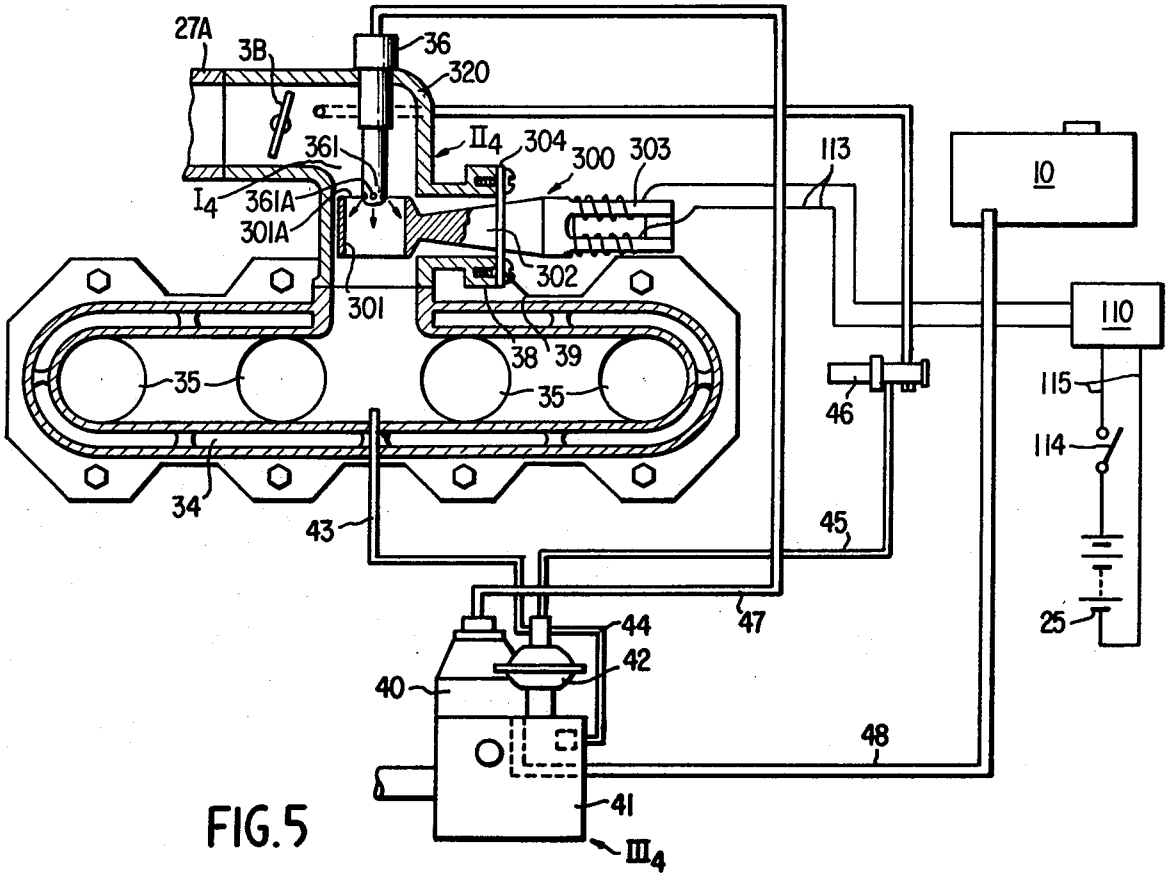
FIG. 5 is a schematic view, partly in cross section, of a fourth embodiment of the invention.

A description will now be given of the second aspect of the invention by referring to the fourth embodiment thereof shown in FIG. 5. According to the ultrasonic wave fuel injection and supply device of the fourth embodiment, a fuel injection device $II_4$ is positioned upstream of a branching point of an intake manifold, while fuel, atomized by means of an ultrasonic vibratory member 301 having a hollow cylindrical body and disposed in the fuel injecting portion, may be distributed to each branch pipe of the manifold for uniform supply of a charge mixture to respective combustion chambers of the engine.

In intake passage $I_4$ defined by a short pipe 320 is connected at its upstream end to an intake tube 27A which leads to an air cleaner, not shown, while the intake passage $I_4$ is connected at its downstream end to an intake chamber 33 serving as a manifold and adapted to distribute and supply a charge mixture into the combustion chambers of the engine. The intake chamber 33 is provided in its wall with warm-water-passing holes 34 adapted to circulate cooling water, for the engine, therethrough, and with branched, intake passages 35 leading to the respective combustion chambers in the multi-cylinder engine.

The intake passage $I_4$ has a portion bent through an angle of about 90°, while a throttle valve 3B, adapted to control the amount of intake air, is positioned in the upstream portion of the aforenoted bent portion. An ultrasonic wave generating body 300, in the fuel injection device $II_4$, is secured to a wall of the intake passage $I_4$ in the downstream portion of the aforenoted bent portion, and an ultrasonic vibratory member 301 is positioned in such a manner as to protrude into the intake passage $I_4$ with the axis of the vibratory member 301 in alignment with the axis of the intake passage. An injection nozzle 36 is secured from a position outside of the passage $I_4$, so as to be disposed within the aforenoted bent portion of the intake passage $I_4$, and a tip portion 361 of the injection nozzle 36 protrudes into the intake passage $I_4$ so as to be positioned on the axis of the vibratory member 301 and extend into an opening 301A of the vibratory member 301 on its upstream side. In addition, a plurality of nozzle openings 361A are positioned about tip 361 with equal circumferential spacing therebetween, the positions of the aforenoted nozzle exits being such that fuel injected therefrom may be supplied to the positions of the nodes of vibration upon the inner peripheral surface of the vibratory member 301 causing flexural vibration thereof.

Ultrasonic wave generation body 300 includes an ultrasonic vibration amplifying block 302 of a conical horn type, which block consists of a frustoconical member and serves as a mechanical vibration amplifying portion. Integrally formed on the small-diameter tip portion of block 302 is a vibratory member 301 designed so as to undergo flexural vibration at the same frequency as that of a resonance frequency of ultrasonic waves from the ultrasonic wave generating body, while a magnetostrictive transducer 303 is secured to the other large-diameter-end portion of block 302. The ultrasonic wave generating body 300 also includes a supporting plate 304 disposed at a position relative to the ultrasonic vibration amplifying block 302 at which the longitudinal vibration thereof is nullified, that is, there appear nodes of vibration at such a location, the supporting plate 304 being secured to a seat 38, provided on a wall of the intake passage $I_4$, by means of a plurality of screws 39.

A lead wire 113 is wound a predetermined number of turns around the magnetorestrictive ultrasonic transducer 303, and leads to an ultrasonic oscillator 110. Connected to the input side of the ultrasonic oscillator is a lead wire 115 which is connected by means of a vibratory-element-starting switch 114 to a power source 25, the aforenoted vibratory-element-starting switch 114 being adapted to cooperate with a starting switch, not shown, for the engine. In addition, a mechanical fuel control and supply system is adopted for controlling the supply and flow rate of the fuel to the injection nozzle 36.

The fuel control and supply device $III_4$ consists of a fuel reservoir 10 adapted to store fuel therein, and a pump 40 driven by the engine for supplying fuel by means of an injection fuel pipe 47 to nozzle 36, the pump 40 being connected to a control means 41 adapted to mechanically control the flow rate of fuel being fed from the pump 40 in response to the R.P.M. of the engine and the intake vacuum pressure of the engine.

The aforenoted control means 41 is provided with a charge mixture control diaphragm chamber 42 which houses a diaphragm which is responsive to the fuel controlling pressure introduced through means of an intake chamber-pressure pipe 43 adapted to introduce the pressure prevailing in the intake chamber 33 serving as a manifold, as well as through a fuel-discharge-amount-compensating-pressure pipe 44 adapted to compensate for a fuel discharge amount in response to the R.P.M. of the engine, and through an idle fuel-compensating pressure pipe 45. Displacement of the diaphragm may actuate an injection fuel control valve provided for the pump 40, thereby controlling the flow rate of the fuel to be injected. An air control valve 46 is adapted to be actuated, in accordance with the temperature of the cooling water for the engine, and a fuel supply pipe 48 has one end thereof communicated with the fuel reservoir 10, and the other end thereof connected to the pump 40.

In operation of the fourth embodiment having the aforenoted arrangement, when the vibratory-element-starting switch 114 is closed due to the starting operation of the internal combustion engine, the ultrasonic oscillator 110 is operated, and electrical oscillations of the same frequency as that of a resonance frequency of ultrasonic waves from the ultrasonic wave generating body 300 are fed from the aforenoted ultrasonic oscillator to the magnetorestrictive type ultrasonic transducer 303, whereby the electrical oscillations are transformed into ultrasonic vibrations. The amplitude of the ultrasonic vibrations thus produced is amplified by the aforenoted ultrasonic vibration amplifying block 302, and subsequently, the ultrasonic vibrations are transmitted to the ultrasonic vibratory member 301. As shown in FIG. 2, referring to the first embodiment, the ultrasonic wave vibratory member 301 is designed so as to cause the fourth order of flexural vibration and causes flexural vibration of a large amplitude, with nodes of vibration appearing at the positions shown at N.

The flow rate of fuel is controlled by means of the fuel control and supply portion $III_4$ upon starting of the internal combustion engine, and the fuel discharged from pump 40 is fed by means of the injection fuel supply pipe 47 to the plurality of exits 361A of the injection nozzle 36 for injection towards the inner peripheral surface of the aforenoted vibratory member 301 and at the position of nodes of vibration thereof, the aforenoted inner peripheral surface causing flexural vibration thereof. Fuel injected onto the nodes of vibration is drawn to such portions of the vibratory surface of the vibratory member, which correspond to the loops or anti-nodes of vibration, whereby the fuel thus drawn forms a film thereover, which in turn is divided into extremely fine particles to be scattered from the vibratory surface in atomized form.

With the ultrasonic wave fuel injection and supply device according to this embodiment, fuel is supplied to the node positions on the vibratory surface causing ultrasonic vibration thereof, thereby enabling consistent, uniform atomization of the fuel throughout a wide range of amounts of fuel being supplied. In addition, in this embodiment, fuel is atomized upon the surface of the hollow cylinder due to the uniform ultrasonic vibration thereof, so that there may be achieved finer and more uniformly-sized particles of atomized fuel as compared with those obtained from prior art devices of this type, and yet a great amount of atomized fuel may be distributed for supply to the four engine cylinders.

Yet furthermore, the wall of the intake chamber 33 serving as a manifold may be warmed by means of heated cooling water for the engine, so that the atomized fuel will not cling to the wall of the passage, but presents an extremely uniform charge mixture, thereby enabling the uniform distribution of the charge mixture for the respective combustion chambers of the multicylinder engine. Accordingly, the device according to this embodiment enables satisfactory combustion of a lean charge mixture, thereby improving the running performance of the engine when using a lean charge mixture, and purification of the exhaust gases due to the prevention of the emission of harmful gas constituents, in addition to improvements in consumption, and the like.

Yet still further, unlike the preceding embodiments, a single fuel injection device enables the production of a charge mixture of an amount required for a multicylinder engine, and uniform distribution of the charge mixture for the respective cylinders of the engine. As a result, the device in this embodiment is simpler in construction than those of the preceding embodiments, while permitting a reduction in cost and maintenance.

While a description has been given of the use of magnetrorestrictive and piezo-electric elements as a ultrasonic transducer for the ultrasonic wave generating portion, it should be construed that the present invention is by no means limited to these structures, but any means having functions similar thereto may be used in place thereof. Moreover, even in the case of piezo-electric and magnetorestrictive elements, this example is merely one example thereof.

In addition, while the description has been had of the ultrasonic vibration amplifying block of an exponential type horn, a stepped type horn, and a conical type horn, the present invention is also by no means limited to these instances, but any type of horn may be used, as long as it is able to amplify mechanical vibrations. For instance, a Fourier type horn, a catenary type horn, or the like, may be used.

Still further, while the description has been given of a vibratory member of a hollow, cylinder in the embodiments, having a circular cross-section, this should not be construed in a limitative sense, but any cylindrically shaped body having open opposite ends and having a thin wall thickness, for instance, a hollow elliptical body, a hollow polygonal body, a hollow cylindrical body having an uneven wall thickness, or the like, may be used in place thereof. A rectangular metal sheet, having given dimensions, may even be formed into a cylindrical shape and a joint portion, and the aforenoted joint portion may be integrally secured to the tip portion of an ultrasonic vibration amplifying portion by welding, or the like, or one end of a hollow cylindrical body which is opposite to its other end secured to another member may be provided as an axially extending slit-like opening.

It will be understood that the above description is merely illustrative of preferred embodiments of the invention. Additional modifications and improvements utilizing the discoveries of the invention can be readily anticipated by those skilled in the art from the present disclosure, and such modifications and improvements may fairly be presumed to be within the scope of the purview of the invention as defined by the appended claims.

What is claimed as new and desired to be secured by Letters Patent of the United States is:

1. An ultrasonic wave fuel injection and supply device comprising:

an intake passage, for supplying an air-fuel mixture therethrough, one end of which is communicated with an air cleaner and the other end of which is communicated with a combustion chamber in an internal combustion engine;

fuel injection means having an ultrasonic wave generating means and a fuel injection nozzle means;

said ultrasonic wave generating means comprising an ultrasonic transforming means, for transforming electrical oscillations into mechanical vibrations, connected to an ultrasonic oscillator, a mechanical vibration amplifying means, for amplifying the amplitude of said mechanical vibrations, secured at one end thereof to said ultrasonic transforming means, and a vibratory member, having a hollow, cylindrically shaped body, a peripheral wall of which is secured to the other end of said mechanical vibration amplifying means, the axis of said vibratory member being positioned substantially perpendicular to the longitudinal axis of said mechanical vibration amplifying means, and said vibratory member being positioned in said intake passage and having open opposite ends so as not to hinder the flow of fluid through said intake passage;

said fuel injection nozzle means having a nozzle opening which opens toward said peripheral wall of said vibratory member for injecting liquid fuel under pressure onto said peripheral wall;

fuel supply means for introducing liquid fuel from a fuel reservoir and for supplying the same to said injection nozzle means; and control means for controlling the amount of fuel being injected through said injection nozzle means in accordance with the running conditions of said internal combustion engine, whereby liquid fuel injected onto said peripheral wall of said vibratory member undergoing ultrasonic vibration may be atomized and scattered due to the ultrasonic vibration thereof, the liquid fuel thus being atomized and scattered being supplied to a combustion chamber of said engine, together with air from said air cleaner.

2. An ultrasonic wave fuel injection and supply device according to claim 1, wherein:

said fuel injection means is respectively provided in said intake passage adjacent to an intake port of each of a plurality of combustion chambers in said engine, whereby said atomized and scattered liquid fuel due to the ultrasonic vibration of said cylindrically shaped vibratory member may be immediately supplied to the respective combustion chambers of said engine.

3. An ultrasonic wave fuel injection and supply device according to claim 1, wherein:

said fuel injection means is a single fuel injection means provided in said intake passage only at the upstream portion of a branching point of an intake manifold connected to a plurality of combustion chambers in said engine, whereby said atomized and scattered liquid fuel due to the ultrasonic vibration of said cylindrically shaped vibratory member may be supplied to said combustion chambers through said intake manifold.

4. An ultrasonic wave fuel injection and supply device according to claim 1, wherein:

said vibratory member has a thin wall of a constant thickness in the axial and radial directions thereof and is one selected from the group consisting of a right hollow and circular cylinder, a hollow elliptical body, a hollow polygonal body, and a hollow cylindrical body made by bending and welding a rectangular metal sheet having predetermined dimensions.

5. An ultrasonic wave fuel injection and supply device according to claim 1, wherein:

said mechanical vibration amplifying means is one selected from the group consisting of an exponential type horn, a stepped type horn, a conical type horn, a Fourier type horn, and a catenary type horn.

6. An ultrasonic wave fuel injection and supply device according to claim 1, wherein:

said ultrasonic transforming means is a means selected from the group consisting of piezo-electric elements and a magnetostrictive element.

7. An ultrasonic wave fuel injection and supply device according to claim 1, wherein:

said fuel injection nozzle means is one selected from the group consisting of a fuel injection nozzle means having an electromagnetic needle valve, a fuel injection nozzle means having an electromagnetic needle valve and a nozzle with a circular opening, a fuel injection nozzl means having an electromagnetic needle valve and a nozzle with an annular opening which injects fuel following a divergent pattern of a conical form, and a fuel injection nozzle means having an electromagnetic needle valve and a nozzle with a plurality of openings provided circumferentially about the tip portion thereof.

8. An ultrasonic wave fuel injection and supply device according to claim 1, wherein:

said control means is one selected from the group consisting of control means of an electrical control type for detecting an air flow rate, control means of an electrical control type for detecting the pressure within an intake pipe, and control means adapted to mechanically control the flow rate of fuel being fed from a pump in response to the R.P.M. value of an engine and the intake vacuum pressure in the engine.

9. An ultrasonic wave fuel injection and supply device according to claim 4, wherein:

said mechanical vibration amplifying means is one selected from the group consisting of an exponential type horn, a stepped type horn, a concial type horn, a Fourier type horn, and a catenary type horn.

10. An ultrasonic wave fuel injection and supply device according to claim 9, wherein:

said ultrasonic transforming means is a means selected from the group consisting of piezo-electric elements and a magnetostrictive element.

11. An ultrasonic wave fuel injection and supply device according to claim 10, wherein:

said fuel injection nozzle means is one selected from the group consisting of a fuel injection nozzle means having an electromagnetic needle valve, a fuel injection nozzle means having an electromagnetic needle valve and a nozzle with a circular opening, a fuel injection nozzle means having an electromagnetic needle valve and a nozzle with an annular opening which injects fuel following a divergent pattern of a conical form, and a fuel injection nozzle means having an electromagnetic needle valve and a nozzle with a plurality of openings provided circumferentially about the tip portion thereof.

12. An ultrasonic wave fuel injection and supply device according to claim 11, wherein:

said control means is one selected from the group consisting of control means of an electrical control type for detecting an air flow rate, control means of an electrical control type for detecting the pressure within an intake pipe, and control means adapted to mechanically control the flow rate of fuel being fed from a pump in response to the R.P.M. value of an engine and the intake vacuum pressure in the engine.

13. An ultrasonic wave fuel injection and supply device according to claim 2, wherein:

said vibratory member is a cylinder having a circular cross-section;

said mechanical vibration amplifying means is an exponential type horn;

said ultrasonic transforming means is a means having piezo-electric elements;

said fuel injection nozzle means comprises an electromagnetic needle valve and a fuel injection nozzle having a circular opening; and said control means is of an electrical control type for detecting an air flow rate.

14. An ultrasonic wave fuel injection and supply device according to claim 13, further comprising:

a short pipe formed of a hollow member interposed between the intake passage connected to said intake port of a combustion chamber and the intake passage formed of an intake pipe having a throttle valve and an air cleaner;

said circular cylinder is coaxially provided in that portion of said intake passage which is formed by the inner surface of said short pipe, said cylinder having a predetermined length between said opposite ends thereof and a thin wall of constant thickness in the axial and radial directions thereof so that the inner and outer peripheral wall surfaces are in coaxial relation with respect to each other, and being integrally secured to a tip portion of said exponential type horn;

a base portion of said exponential type horn has a flange fixed to a seat on an outer surface of said short pipe by bolt means through an annular member and has a portion connected to said tip portion of said exponential type horn by means of a bolt;

said ultrasonic transforming means comprises a cylindrical metal backing block having a circular flange, and two circular piezoelectric elements and an electrode plate which are sandwiched between said metal backing block and said base portion of said exponential type horn by said bolt means;

said fuel injection nozzle means is provided on a side wall of said short pipe and is inclined at an angle of approximately 45° with respect to the axis of said intake passage, said circular opening of said nozzle being directed toward the center of the vibratory member so as to inject fuel onto the inner and outer peripheral surfaces of said vibratory member;

said fuel supply device comprises a fuel reservoir, a fuel pump connected by means of a tube to said fuel reservoir, a pressure regulator connected by means of a fuel filter and a fuel transporting tube to said pump, an excessive-fuel-discharge tube connected from said pressure regulator to said fuel reservoir, and an injection fuel supply tube connected to said fuel transporting tube and to said fuel injection nozzle means so as to supply the fuel under pressure from the fuel pump to said fuel injection nozzle means; and said control means comprises a control unit connected to said ultrasonic oscillator, a starting switch, a power source for said fuel pump, an air flow meter, for detecting the flow rate of air flowing through said intake passage as a rotational displacement of a gauge plate and for feeding an electrical signal converted by a potentiometer to said control unit, which is provided upstream of said throttle valve in said intake passage, means, for feeding an ignition signal to said control unit, connected to a distributor and said control unit, a temperature sensor which is provided upon the block of said engine and which detects the temperature of the cooling water in said engine and feeds said detected temperature signal to said control unit, an auxiliary air valve which is provided in an air bypass connected unpstream and downstream of said throttle valve in said intake passage so as to vary the idle air flow rate in response to the temperature of said cooling water in order to maintain an optimum idle R.P.M. from the starting of said engine until the same reaches the optimum warming-up temperature, and to adjust the air-fuel ratio of the charge mixture during warming-up by said control unit, and a throttle switch, which is operable in association with said throttle valve and which detects the deceleration timing of said engine based upon a signal from said throttle valve and upon the engine R.P.M. detected by means of an ignition signal from said distributor, connected to said control unit, whereby said control unit determines the amount of fuel injected in response to the running conditions of said engine by said signals from said air flow meter and said means connected to the distributor, feeds a control signal to a solenoid of said electromagnetic needle valve in said fuel injection nozzle means, and interrupts the supply of fuel as a result of said signal from said throttle switch.

15. An ultrasonic wave fuel injection and supply device according to claim 2, wherein:

said vibratory member of a hollow cylindrically shaped body is a right, circular cylinder;

said mechanical vibration amplifying means is a stepped type horn;

said ultrasonic transforming means is a means having piezoelectric elements;

said fuel injection nozzle means comprises an electromagnetic needle valve and a fuel injection nozzle having an annular opening; and said control means is of the electrical control type for detecting pressure within an intake pipe.

16. An ultrasonic wave fuel injection and supply device according to claim 15, further comprising:

a short pipe formed of an L-shaped hollow member having a throttle valve and interposed between the intake passage in a cylinder head connected to said intake port of a combustion chamber and the intake passage formed of an intake pipe having an air cleaner;

said right, circular cylinder and stepped type horn are integrally formed as one body, the base portion of which has a flange fixed to a seat on an outer surface of said short pipe by bolt means through an annular member;

said right, circular cylinder is coaxially provided at the central portion of that portion of the intake passage which is formed by the inner surface of said short pipe, said cylinder having a predetermined length between said opposite ends thereof and having a thin wall of constant thickness in the axial and radial directions thereof so that the inner and outer peripheral wall surfaces are in coaxial relation with respect to each other;

said ultrasonic transforming means comprises a cylindrical metal backing block having a circular flange, and two circular piezoelectric elements and an electrode plate which are sandwiched between said metal backing block and said base portion of said one body by said bolt means;

said fuel injection nozzle means is provided on a side wall of a bent portion of said short pipe, and the center of said annular opening of said nozzle is in alignment with the axis of said vibratory member and extends into an opening surrounded by the inner wall surface of said vibratory member;

said fuel supply device comprises a fuel reservoir, a fuel pump connected by means of a tube to said fuel reservoir, a pressure regulator connected by means of a fuel filter and a fuel transporting tube to said pump, an excessive-fuel-discharge tube connected from said pressure regulator to said fuel reservoir, and an injection fuel supply tube connected to said fuel transporting tube and to said fuel injection nozzle means so as to supply the fuel under pressure from the fuel pump to said fuel injection nozzle means; and said control means comprises a control unit connected to said ultrasonic oscillator, a starting switch, a power source for said fuel pump, a sensor, secured to the wall of said intake passage at a position downstream of said bent portion of said intake passage, for detecting within said intake pipe the pressure of a mixture to be introduced into a combustion chamber in said engine and which feeds an electrical signal to said control unit, means, for feeding an ignition signal to said control unit, connected to a distributor and said control unit, two temperature sensors which are respectively provided upon the cylinder head and crankcase, and which feed electrical signals based on the temperatures of said cylinder head and crankcase to said control unit, an intake-pipe-internal-pressure switch which is provided upon a side wall of said short pipe and connected to said control unit and which is actuated when the engine output is to be increased under a running condition approximating a fully opened position of said throttle valve, and a throttle switch, which is operable in association with said throttle valve and detects the deceleration timing of said engine based upon a signal from said throttle valve and upon the engine R.P.M. as detected by an ignition signal from said distributor, connected to said control unit, whereby said control unit determines the amount of fuel injected in response to the running conditions of said engine by said signals from said sensor, said means connected to said distributor, said two temperatures sensors and said intake-pipe-internal-pressure switch, feeds a control signal to a solenoid of said electromagnetic needle valve in said fuel injection nozzle means, and interrupts the supply of fuel as a result of said signal from said throttle switch.

17. An ultrasonic wave fuel injection and supply device according to claim 2, wherein:

said vibratory member is a right, circular cylinder;

said mechanical vibration amplifying means is a stepped type horn;

said ultrasonic transforming means is a means having piezoelectric elements;

said fuel injection nozzle means comprises an electromagnet needle valve and a fuel injection nozzle having an annular opening; and said control means is of the electrical control type for detecting an air flow rate.

18. An ultrasonic wave fuel injection and supply device according to claim 17, further comprising:

a short pipe formed of a hollow member, one half of which is disposed within the cylinder head and is postioned adjacent to an intake port in said cylinder head of said engine;

said right, circular cylinder and stepped type horn are integrally formed as one body, the base portion of which has a flange fixed to a seat on an outer surface of said short pipe by bolt means through an annular member;

said right, circular cylinder is coaxially provided at the central portion of that portion of the intake passage which is formed by the inner surface of said short pipe, said cylinder having a predetermined length between said opposite ends thereof and having a thin wall of a constant thickness in the axial and radial directions thereof so that the inner and outer peripheral wall surfaces are in coaxial relation with respect to each other;

said ultrasonic transforming means comprises a cylindrical metal backing block having a circular flange, and two circular piezoelectric elements and an electrode plate which are sandwiched between said metal backing block and said base portion of said one body by said bolt means;

said fuel injection nozzle means is provided upon a side wall of a bent portion of a bent intake passage connected to said short pipe, and the center of the annular opening of said nozzle is in alignment with the axis of said vibratory member and extends into an opening surrounded by the inner wall surface of said vibratory member;

said fuel supply device comprises a fuel reservoir, a fuel pump connected by means of a tube to said fuel reservoir, a pressure regulator connected by means of a fuel filter and a fuel transporting tube to said pump, an excessive-fuel-discharging tube connecting said pressure regulator to said fuel reservoir, and an injection fuel supply tube connected to said fuel transporting tube and to said fuel injection nozzle means so as to supply the fuel under pressure from the fuel pump to said fuel injection nozzle means; and said control means comprises a control unit connected to said ultrasonic oscillator, a starting switch, a power source for said fuel pump, an air flow meter, for detecting the flow rate of air flowing through said intake passage as a rotational displacement of a gauge plate and for feeding an electrical signal converted by a potentiometer to said control unit, which is provided upstream of said throttle valve in said intake passage, means, for feeding an ignition signal to said control unit, connected to a distributor and said control unit, a temperature sensor which is provided upon the block of said engine and which detects the temperature of the cooling water in said engine and feeds said detected temperature signal to said control unit, an auxiliary air valve which is provided in an air bypass connected upstream and downstream of said throttle valve in said intake passage so as to vary the idle air flow rate in response to the temperature of said cooling water in order to maintain an optimum idle R.P.M. from the starting of said engine until the same reaches an optimum warming-up temperature, and to adjust the air-fuel ratio of the charge mixture during warming-up by said control unit, and a throttle switch, which is operable in association with said throttle valve and which detects the deceleration timing of said engine based upon a signal from said throttle valve and upon the engine R.P.M. detected by means of an ignition signal from said distributor, connected to said control unit, whereby said control unit determines the amount of fuel injected in response to the running conditions of said engine by said signals from said air flow meter and said means connected to the distributor, feeds a control signal to a solenoid of said electromagnetic needle valve in said fuel injection nozzle means, and interrupts the supply of fuel as a result of said signal from said throttle switch.

19. An ultrasonic wave fuel injection and supply device according to claim 3, wherein:

said vibratory member is a right, circular cylinder;

said mechanical vibration amplifying means is a conical type horn;

said ultrasonic transforming means is a means having a magnetostrictive element;

said fuel injection nozzle means comprises an electromagnetic needle valve and a fuel injection nozzle having a plurality of openings; and said control means is of the mechanical control type for detecting the pressure in said intake passage and the R.P.M. of said engine.

20. An ultrasonic wave fuel injection and supply device according to claim 19, further comprising:

an L-shaped short pipe comprising a hollow annular member interposed between an intake passage having an air cleaner and an intake manifold attached to the cylinder head of a multicylinder engine;

said right, circular cylinder is integrally formed with a tip portion of said conical type horn and is coaxially provided at the central portion of said intake passage formed by an inner surface of said short pipe, and has a predetermined length between said opposite ends thereof and a thin wall of a constant thickness in the axial and radial directions thereof so that the inner and outer peripheral wall surfaces are in coaxial relation with respect to each other;

said conical type horn comprises a frusto-conical member connected to a magnetostrictive transducer, having a lead wire wound therearound connected to said ultrasonic oscillator, at a base portion having a larger diameter, and an annular supporting plate, for supporting said frusto-conical member at the node position of vibration, which is secured to a seat provided on a wall of said short pipe by means of a plurality of screws;

said fuel injection nozzle means is attached to a bent portion of said L-shaped short pipe and is coaxially provided in said intake passage formed by an inner surface of said short pipe, a tip portion of said injection nozzle is disposed within said vibratory member, said plurality of openings of said tip portion of said injection nozzle are disposed therearound and positioned with equal circumferential spacings therebetween so as to inject the fuel under pressure to the positions of the nodes of vibration upon the inner peripheral surface of the vibratory member causing flexural vibration;

said fuel supply device comprises a fuel reservoir adapted to store fuel, and a pump, driven by said engine, for supplying said fuel by means of an injection fuel pipe to said fuel injection nozzle means, said pump being connected to said control means; and said control means comprises a charge mixture control diaphragm chamber which houses a diaphragm responsive to the fuel controlling pressure introduced through an intake chamber pressure pipe adapted to introduce the pressure prevailing in said intake chamber, a fuel-discharge-amount-compensating pipe, and an idle-fuel compensating-pressure pipe, said fuel-discharge-amount-compensating pipe being adapted to compensate for the fuel discharge amount in response to the R.P.M. of said engine by actuating an injection fuel control valve of said pump based upon the displacement of said diaphragm; an air control valve actuated in response to the temperature of the cooling water for said engine; and a fuel supply pipe connected to said fuel reservoir and said pump.

21. An ultrasonic wave fuel injection and supply device according to claim 1, wherein:

said vibratory member has a predetermined length between said opposite ends thereof and a thin wall of constant thickness in the axial and radial directions thereof so that the inner and outer peripheral surfaces are in coaxial relation with respect to each other.

* * * * *